United States Patent [19]

Strahan

[11] Patent Number: 4,833,808

[45] Date of Patent: May 30, 1989

[54] ANTI-RECOIL DEVICE

[76] Inventor: Travis Strahan, Rte. 7, Townsend Cir., Ringgold, Ga. 30736

[21] Appl. No.: 155,565

[22] Filed: Feb. 12, 1988

[51] Int. Cl.[4] ..... F41C 21/18

[52] U.S. Cl. ..... 42/1.06; 89/14.3

[58] Field of Search ..... 42/1.06; 89/14.3, 1.7, 89/42.01

[56] References Cited

U.S. PATENT DOCUMENTS

| | | | |
|---|---|---|---|
| 2,372,315 | 3/1945 | Catron | 42/1.06 |
| 2,679,192 | 5/1954 | Seeley et al. | 42/1.06 |
| 3,018,694 | 1/1962 | Browning | 42/1.06 |
| 3,208,348 | 9/1965 | Lee | 89/14.3 |
| 4,088,057 | 5/1978 | Nasypany | 42/1.06 |
| 4,156,979 | 6/1979 | Katsenes | 42/1.06 |
| 4,492,050 | 1/1985 | Kagehiro | 42/1.06 |
| 4,503,632 | 3/1985 | Cuevas | 42/1.06 |

*Primary Examiner*—Deborah L. Kyle
*Assistant Examiner*—Michael J. Carone
*Attorney, Agent, or Firm*—James B. Middleton

[57] ABSTRACT

An anti-recoil device can be mounted on the muzzle end of a firearm. The device includes a barrel extension, and provides a weight surrounding the barrel extension. Gas from the bore is diverted to move the weight forward, preferably at the speed of the bullet; then, the weight is abruptly stopped when the bullet leaves the muzzle. The forwardly directed force to stop the weight effectively counteracts the rearwardly direction force of the muzzle recoil. A washer of an elastomeric material can be used at the stop to prevent damage to metal parts, and to distribute the stopping over a short period of time.

5 Claims, 1 Drawing Sheet

ANTI-RECOIL DEVICE

INFORMATION DISCLOSURE STATEMENT

Since the beginning of firearms, there has been a problem of recoil when the firearm is discharged. With relatively low power firearms, it is obvious that the recoil is a minimal problem, especially when the firearm itself is quite heavy so the mass of the firearm absorbs a great part of the energy of the recoil. As firearms become more powerful and lighter in weight relative to their power, the recoil becomes an increasing problem.

Those skilled in the art have long been aware that many automatic firearms tend to have a net effect of moving forward rather than rearward because of the constant forward movement of the bolt and other portions of the gas operating system, but this is a special and limited phenomenon, occurring only in firearms with a sufficiently heavy bolt and operating mechanism while operating in a fully automatic mode.

There has been some effort at counteracting the recoil of a single shot or semi-automatic firearm, but this has normally taken the form of expelling gasses forwardly from the firearm approximately at the time the bullet leaves the muzzle. Such a system has the severe drawback of producing loud noise, and discharging gas from behind the bullet just before the bullet emerges from the muzzle which can reduce the velocity of the bullet. Also, a gas operated firearm may utilize the gas to urge the bolt and other mechanism rearwardly for reloading the firing chamber; however, in such a system, the forward motion of the bolt and associated mechanism is generally after the firearm has recoiled rearwardly at the point of discharge of the bullet.

It will therefore be seen that the prior art does not include a simple and effective device for effectively cancelling the recoil of the firearm at the time the bullet leaves the muzzle.

SUMMARY OF THE INVENTION

This invention relates generally to anti-recoil devices for firearms, and is more particularly concerned with a mechanical means for counteracting the recoil, the mechanical means being operated from the gas in the barrel.

The present invention provides, in a firearm, a weight or the like that is set in motion by gas pressure from the barrel. The weight moves forwardly substantially with the bullet; and, at the time the bullet emerges from the barrel, allowing the discharged gas to provide a recoil force, the weight of the present invention is stopped by stop means carried by the barrel. The rearward force of the recoil and the forward force of the weight substantially cancel each other so the net force is negligible.

In one embodiment of the invention, the weight is in the form of a piston, the piston being normally urged rearwardly against spring tension, but being urged forwardly by gas pressure. A somewhat elastomeric material may be used as a stop means to extend the force over a brief period of time.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
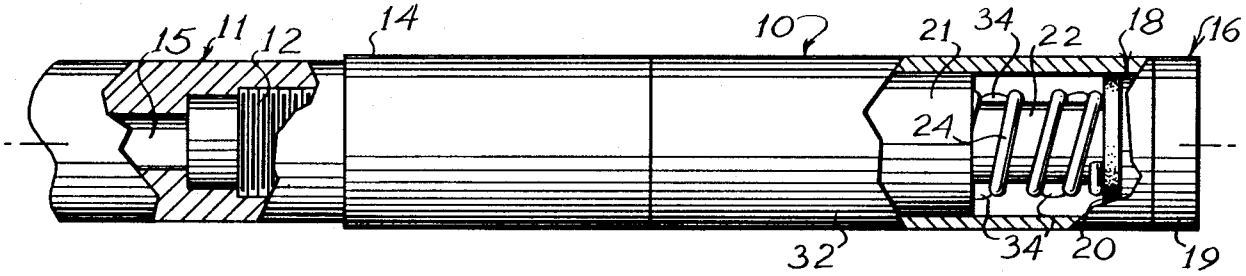
FIG. 1 is a side elevational view of an anti-recoil device made in accordance with the present invention, the device being mounted at the end of the barrel of a firearm, portions thereof being broken away to show the construction; and, FIG. 2 is a longitudinal cross-sectional view of the device shown in FIG. 1.

Referring now more particularly to the drawings, and to that embodiment of the invention here presented by way of illustration, FIG. 1 shows the anti-recoil device generally designated at 10 fixed to the forward end of the barrel of a firearm generally designated at 11. The anti-recoil device 10 includes a threaded shank 12 at its inner, or proximal, end 14, the threaded shank 12 being received by threads within the bore 15 of the firearm 11. It will of course be realized that the firearm 11 may be a pistol, a rifle, or even larger guns and the like.

The distal end 16 of the anti-recoil device 10 includes a stop member 18 which includes a plug 19 and a washer 20. Towards the proximal end of the device, there is a piston 21 which is slidable along the central shaft 22, the shaft 22 also being an extension of the barrel of the gun 11. It will be seen that there is a spring 24 that surrounds the shaft 22 for urging the piston 21 rearwardly.

While the particular embodiment of the invention here chosen by way of illustration has the weight coaxially mounted with respect to the gun barrel, it will be readily seen that the weight can be otherwise mounted. The important features are that the weight must move parallel to the centerline of the barrel, and must move with the bullet to be stopped at the proper time. The embodiment disclosed is the preferred form of the invention, but many other forms are equally usable.

With this brief description, it will be understood that, when the gun 11 is fired, the bullet will move through the bore 15, and continue into the bore extension 25 of the anti-recoil device 10. At an appropriate point, gas will be diverted from the bore extension 25 to drive the piston 21 forwardly, towards the distal end of the anti-recoil device 10. The piston 21 will move rapidly, then will be abruptly stopped by the stop member 18, though the time for stopping will be slightly extended because of the elastomeric washer 20.

Figure 2:
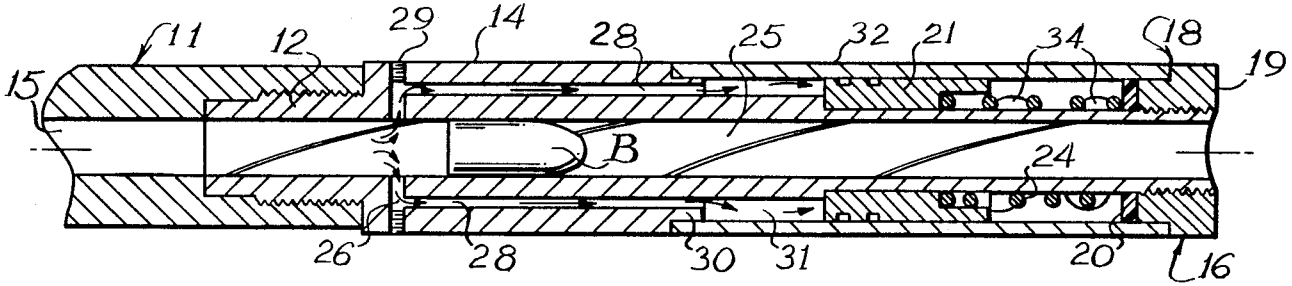

Attention is next directed to FIG. 2 of the drawings for a more detailed understanding of the construction of the anti-recoil device 10.

In FIG. 2 it will be seen that the threaded shank 12 is formed integrally with the main body of the anti-recoil device 10, the threaded shank 12 including a rifled bore extension 25 which is continuous throughout the anti-recoil device 10, through the distal end 16. Those skilled in the art will understand that the bore extension 25 will be rifled in the same manner as the barrel of the gun 11 with which the device is to be used since the motion of the bullet indicated at B should not be interrupted in its path from the bore 15 to the bore extension 25.

Just beyond the muzzle end of the gun 11, there are radially extending passages 26 which allow gas from the bore extension 25 to pass from the bore extension 25 and into longitudinally extending passages 28. It will be noted that the radial passages 26 have screws 29 in their outer ends. While the use of the screws 29 is not necessary, it will be realized that convenience in machining will require that a hole simply be drilled radially through the device to provide the passages 26; and, one can then thread the outer extremities of the holes and provide the screws 29.

The longitudinally extending passages 28 terminate at a stepped area 30 of the anti-recoil device 10, so it will be possible to drill the passageways 28 without unusual difficulty. The passageways 28 therefore open into the chamber 31 in which the piston 21 rides. A sleeve 32 covers the chamber 31, and is held between the stepped portion 30 and the plug 19 at the distal end of the anti-recoil device 10.

Looking at the forward portion of the chamber 31, it will be noted that there are openings 34 through the sleeve 32. With attention to FIG. 2 of the drawings, it will be readily understood that, as the piston 21 is moved distally, towards the stop 18, air within the chamber 31 will be compressed to retard or prevent motion of the piston 21. As a result, the forward portion of the chamber 31 is vented to atmosphere by holes such as the openings 34. By opening the forward portion of the chamber 31 to atmosphere, the piston 21 is allowed to move freely towards the distal end of the anti-recoil device 10; and, after the bullet B has left the end of the bore extension 25, the rear end of the chamber 31 is vented through the passages 28 and 26, and the bore extension 25.

From the foregoing discussion, operation of the device should now be fully understandable. The anti-recoil device 10 is usable on virtually any firearm for controlling the muzzle recoil. The muzzle end of the gun 11 must be provided with appropriate threads for receiving the threaded shank 12, and of course the rifling within the bore extension 25 should be made to match the rifling in the barrel of the gun 11 to achieve a smooth transition by the bullet B from the bore 15 to the bore extension 25.

As the bullet B passes the end of the muzzle of the gun 11, some of the gas behind the bullet B is diverted into radial passages 26, then to longitudinally extending passageways 28. The gas from the passageways 28 will pressurize the chamber 31 behind the piston 21, causing the piston 21 to move forwardly, or towards the distal end 16 of the anti-recoil device 10. It is contemplated that, once the piston 21 begins to move, the piston 21 will move approximately at the velocity of the bullet B, so the piston 21 and the bullet B will move somewhat together during the final portion of the bore extension 25.

The critical point for recoil control is the time period during which the bullet B leaves the bore extension 25, or the bore 15 when the anti-recoil device is not utilized. After the bullet B leaves the bore, the gas is expelled from the bore, the gas being expelled forwardly at a high velocity. Thus, in the anti-recoil device of the present invention, substantially at the time the bullet B leaves the end of the bore extension 25, the piston 21 will engage the washer 20 of the stop 18.

One could of course use simply the metal piston 21 engaging the metal plug 19 to counteract the recoil. It will be understood, however, that this metal-against-metal would cause a substantially instantaneous force that would not be coextensive in time with the recoil caused by discharge of the gasses from the muzzle. Thus, in an effort both to prevent potential damage to the metal parts and to extend the force over a brief period of time, the washer 20 is provided. The washer 20 may be made of a polyolefin such as polyethylene or the like, a halogenated hydrocarbon such as polytetrafluroethylene, a polyurethane, or virtually any other elastomeric material. The above mentioned elastomers as well as natural rubbers can be utilized, and their characteristics can be varied to achieve the desired resilience.

Those skilled in the art will of course understand that the particular embodiment of the invention here presented is by way of illustration only, and is meant to be in no way restrictive; therefore, numerous changes and modifications may be made, and full use of equivalents resorted to, without departing from the spirit or scope of the invention as outlined in the appended claims.

I claim:

1. An anti-recoil device, for use on a firearm, wherein said firearm includes a barrel having a muzzle end for propelling a bullet therefrom by gas pressure, said anti-recoil device including a weight movable along a line parallel to the centerline of said barrel, a sleeve defining a chamber for said weight, passage means for diverting gas from behind a bullet in said barrel into said chamber behind said weight for causing forward motion of said weight, and stop means for stopping forward motion of said weight substantially at the time said bullet leaves said muzzle of said barrel, said weight being annular and coaxial with said barrel, said stop means being substantially at said muzzle end of said barrel, and further including spring means for urging said weight rearwardly, said spring means acting between said weight and said stop means, said stop means including an elastomeric washer to be engaged by said weight.

2. An anti-recoil device as claimed in claim 1, said anti-recoil device comprising a body, means for mounting said body at said muzzle end of said barrel, said body defining a bore extension therethrough, said bore extension being coaxial with said barrel, said sleeve being coaxial with said bore extension, and defining a rear chamber between said muzzle and said weight and a forward chamber between said weight and said stop means, said passage means connecting said bore extension with said rear chamber.

3. An anti-recoil device as claimed in claim 2, said stop means comprising a plug closing the forward end of said sleeve, and a washer within said forward chamber generally contiguous with said plug.

4. An anti-recoil device as claimed in claim 3, said washer being formed of an elastomeric material, said forward chamber being open to the atmosphere.

5. An anti-recoil device as claimed in claim 4, said bore extension including rifling like that of said barrel.

* * * * *